US006082736A

United States Patent [19]

Barlow

[11] Patent Number: 6,082,736

[45] Date of Patent: Jul. 4, 2000

[54] MULTIPURPOSE GAME ASSEMBLY WHICH INCLUDES A TABLE TENNIS ASSEMBLY, A BOWLING ASSEMBLY, A BILLIARDS ASSEMBLY, A BASKETBALL ASSEMBLY, AND A HOCKEY ASSEMBLY

[75] Inventor: Gordon Barlow, Highland Park, Ill.

[73] Assignee: Fundex Games, Ltd., Indianapolis, Ind.

[21] Appl. No.: 09/146,394

[22] Filed: Sep. 3, 1998

[51] Int. Cl.[7] ..... A63F 7/20; A63D 3/00

[52] U.S. Cl. ..... 273/317.1; 473/14; 473/496; 473/116; 273/108.1; 273/407; 273/126 R; 273/317.3; 273/396

[58] Field of Search ..... 473/459, 475, 473/462, 491, 496, 415, 416, 422, 431, FOR 113, FOR 212, 10, 434, 474, 14, 115, 116; 273/410, 394, 407, 396, 397, 108.1, 317.1, 317.3, 126 R

[56] References Cited

U.S. PATENT DOCUMENTS

| | | |
|---|---|---|
| 2,066,159 | 12/1936 | Post . |
| 2,247,657 | 7/1941 | Girden . |
| 2,508,461 | 5/1950 | Lemon . |
| 2,629,594 | 2/1953 | Forsyth . |
| 2,781,194 | 2/1957 | Sistrunk . |
| 3,088,735 | 5/1963 | Clark . |
| 3,561,762 | 2/1971 | Russell . |
| 3,891,210 | 6/1975 | Horne . |
| 3,891,213 | 6/1975 | Cooper . |
| 4,345,758 | 8/1982 | Kempf . |
| 4,417,728 | 11/1983 | Hay . |
| 4,772,018 | 9/1988 | Inniger . |
| 4,886,269 | 12/1989 | Marocco . |
| 5,354,051 | 10/1994 | Fehrenbach . |
| 5,470,057 | 11/1995 | Bodford . |
| 5,935,024 | 8/1999 | Lao . |

FOREIGN PATENT DOCUMENTS

| | | | |
|---|---|---|---|
| 2219177 | 10/1973 | Germany | 473/FOR 113 |
| 489225 | 7/1938 | United Kingdom | 473/FOR 113 |

*Primary Examiner*—Sebastiano Passaniti
*Attorney, Agent, or Firm*—Maginot, Addison & Moore

[57] ABSTRACT

A table tennis assembly which includes (i) a net, (ii) a lower playing surface positioned on a first side of the net, and (iii) an upper playing surface positioned on a second side of the net. The upper playing surface is oriented in relation to the net and the lower playing surface such that a ping pong ball rolling on the upper playing surface toward the lower playing surface will be directed (i) over the net and (ii) onto the lower playing surface after the ping pong ball rolls off of the upper playing surface. The table tennis assembly also includes a return surface which extends upwardly from a first rear edge of the upper playing surface.

18 Claims, 11 Drawing Sheets

MULTIPURPOSE GAME ASSEMBLY WHICH INCLUDES A TABLE TENNIS ASSEMBLY, A BOWLING ASSEMBLY, A BILLIARDS ASSEMBLY, A BASKETBALL ASSEMBLY, AND A HOCKEY ASSEMBLY

BACKGROUND OF THE INVENTION

The present invention generally relates to a multipurpose game assembly which allows several games to be played. The present invention particularly relates to a table tennis assembly included in the mutipurpose game assembly.

Many games are designed to simulate various actual "real life" sports or games. For example, there are games designed to simulate the excitement and competition of an actual bowling or billiards tournament. In addition, there are games designed to simulate the excitement and competition of a hockey game, a basketball game, or a table tennis match (also referred to as ping pong).

However, the aforementioned games suffer from several drawbacks. For example, table tennis games need to be relatively small and compact so they can be easily transported and then stored in a relatively small space when not in use. However, the relatively small size of these table tennis games makes it extremely difficult to simulate the action provided by an actual table tennis match being played on a full size table. In particular, the relatively small size of the playing surface of these table tennis games necessitates that the players be a relatively short distance apart as compared to when playing table tennis on a full size table. The close proximity of the players greatly reduces the reaction time an opposing player has to react and return an "in play" ping pong ball. The reduction of reaction time causes the players to frequently miss the ping pong ball which in turn decreases the volleying. Decreasing the volleying decreases the competitive nature of the game and thus reduces its entertainment value.

One way players attempt to compensate for the aforementioned reduction in reaction time is to strike the ping pong ball with much less force so as to decrease the velocity thereof. While this strategy effectively increases the opposing player's reaction time, and thus increases the probability of a volley, it also decreases the entertainment value of the game because gingerly striking the ping pong ball tends to bore the participants. In addition, having to gingerly strike the ping pong ball does not simulate an actual table tennis match well since the participants of an actual table tennis match typically attempt to aggressively strike the ping pong ball with a relatively large amount of force.

The other aforementioned games (i.e. bowling, billiards, basketball, and hockey) also suffer from design flaws which detract from their simulation of the actual activity. In particular, bowling games do not allow a player to utilize or compensate for any spin (or "english") placed on the bowling ball. The spin utilized in actual bowling results in the bowling ball "hooking" as it travels down the bowling alley. This "hooking" adds to the excitement and strategy of actual bowling. Therefore, the inability to "hook" the bowling ball in bowling games detracts from their entertainment value. Moreover, the mechanisms used to reset the bowling pins in these bowling games tend to be awkward and inefficient.

With respect to hockey games, these games are either played too slow or the "hockey puck" tends to fly off of the playing surface which interrupts the continuity of the game and detracts from its realism. Basketball games suffer from similar drawbacks. For example, basketball games are typically not very exciting (i.e. played too slow) and their design does not allow direct competition with an opponent. Both of these design flaws detract from the fun and realism of basketball games.

Billiards games do not allow a player to put a spin (i.e. english) on a billiard ball which reduces the fun and excitement of the game. Furthermore, these games typically attach the billiard cue to the billiard table thereby reducing the realism of the game.

Furthermore, an additional problem with the above described games is that typically none of them by themselves is very versatile. Therefore, after repeatedly playing one game for a certain period of time the players tend to lose interest which shortens the game's useful "life" as an entertainment device.

The present invention is directed to overcoming one or more of the problems set forth above.

SUMMARY OF THE INVENTION

In accordance with one embodiment of the present invention, there is provided a table tennis assembly. The table tennis assembly includes (i) a net, (ii) a lower playing surface positioned on a first side of the net, and (iii) an upper playing surface positioned on a second side of the net. The upper playing surface is oriented in relation to the net and the lower playing surface such that a ping pong ball rolling on the upper playing surface toward the lower playing surface will be directed (i) over the net and (ii) onto the lower playing surface after the ping pong ball rolls off of the upper playing surface.

In accordance with another embodiment of the present invention there is provided a table tennis assembly. The table tennis assembly includes (i) a net, (ii) a lower playing surface positioned on a first side of the net, and (iii) an upper playing surface positioned on a second side of the net. The upper playing surface is oriented in relation to the net and the lower playing surface such that a ping pong ball rolling on the upper playing surface toward the lower playing surface will be directed (i) over the net and (ii) onto the lower playing surface after the ping pong ball rolls off of the upper playing surface. The table tennis assembly also includes a return surface which extends upwardly from a first rear edge of the upper playing surface.

In accordance with yet another embodiment of the present invention there is provided a table tennis assembly. The table tennis assembly includes (i) a net, (ii) a lower playing surface positioned on a first side of the net, and (iii) an upper playing surface positioned on a second side of the net. The upper playing surface is oriented in relation to the net and the lower playing surface such that a ping pong ball rolling on the upper playing surface toward the lower playing surface will be directed (i) over the net and (ii) onto the lower playing surface after the ping pong ball rolls off of the upper playing surface. The table tennis assembly also includes a multipurpose game base, wherein the net, the lower playing surface, and the upper playing surface are attached to the multipurpose game base.

It is therefore an object of the present invention to provide a new and useful multipurpose game assembly.

It is another object of the present invention to provide an improved multipurpose game assembly.

It is also an object of the present invention to provide a new and useful table tennis assembly.

It is another object of the present invention to provide an improved table tennis assembly.

It is still another object of the present invention to provide a new and useful bowling assembly.

It is another object of the present invention to provide an improved bowling assembly.

It is still another object of the present invention to provide a new and useful hockey assembly.

It is another object of the present invention to provide an improved hockey assembly.

It is still another object of the present invention to provide a new and useful basketball assembly.

It is another object of the present invention to provide an improved basketball assembly.

It is still another object of the present invention to provide a small compact portable multipurpose game assembly which includes a table tennis assembly, a bowling assembly, a hockey assembly, and a basketball assembly which allows games to be played that simulate the actual "real life" activity.

It is another object of the present invention to provide a small compact portable multipurpose game assembly which is versatile so as to maintain the interest of a player and thus have a relatively long useful "life" as an entertainment device.

It is yet another object of the present invention to provide a table tennis assembly which is relatively small, compact, and portable but still allows the players to volley while aggressively striking a ping pong ball with a large amount of force thereby simulating the action and excitement provided by an actual table tennis match being played on a full size table.

It is yet another object of the present invention to provide a bowling assembly which allows a player to place spin or "english" on the bowling ball so as to simulate actual bowling.

It is still another object of the present invention to provide a bowling assembly which has a bowling pin resetting mechanism which is convenient and efficient.

It is also an object of the present invention to provide a hockey assembly which maintains the continuity of the game by ensuring that the "hockey puck" remains on the playing surface during play.

It is further an object of the present invention to provide a hockey assembly which allows a fast paced hockey game to be played thereon so as to simulate an actual hockey game.

It is yet another object of the present invention to provide a basketball assembly which is more exciting relative to comparable basketball games and allows direct competition between the players.

The above and other objects, features, and advantages of the present invention will become apparent from the following description and attached drawings.

DETAILED DESCRIPTION OF THE PREFERRED EMBODIMENT

Figure 1:
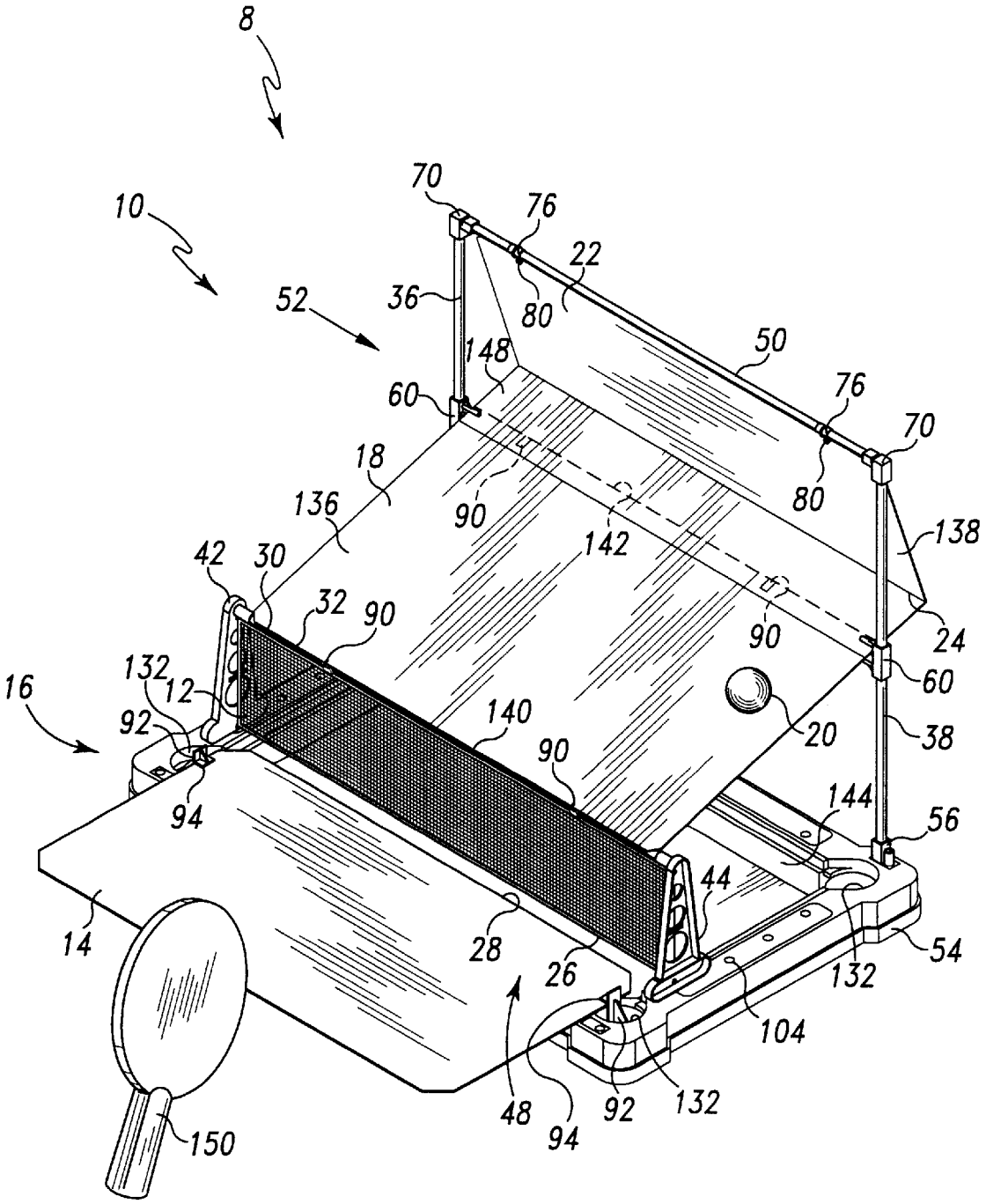
FIG. 1 is a front perspective view of a table tennis assembly which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

This invention relates to a multipurpose game assembly which can be converted between a variety of different games such as a table tennis assembly 10 (see FIG. 1), a bowling assembly 106 (see FIG. 11), a hockey assembly 108 (see FIG. 14), a basketball assembly 110 (see FIG. 19), and a pool assembly (not shown).

TABLE TENNIS ASSEMBLY

Figure 2:
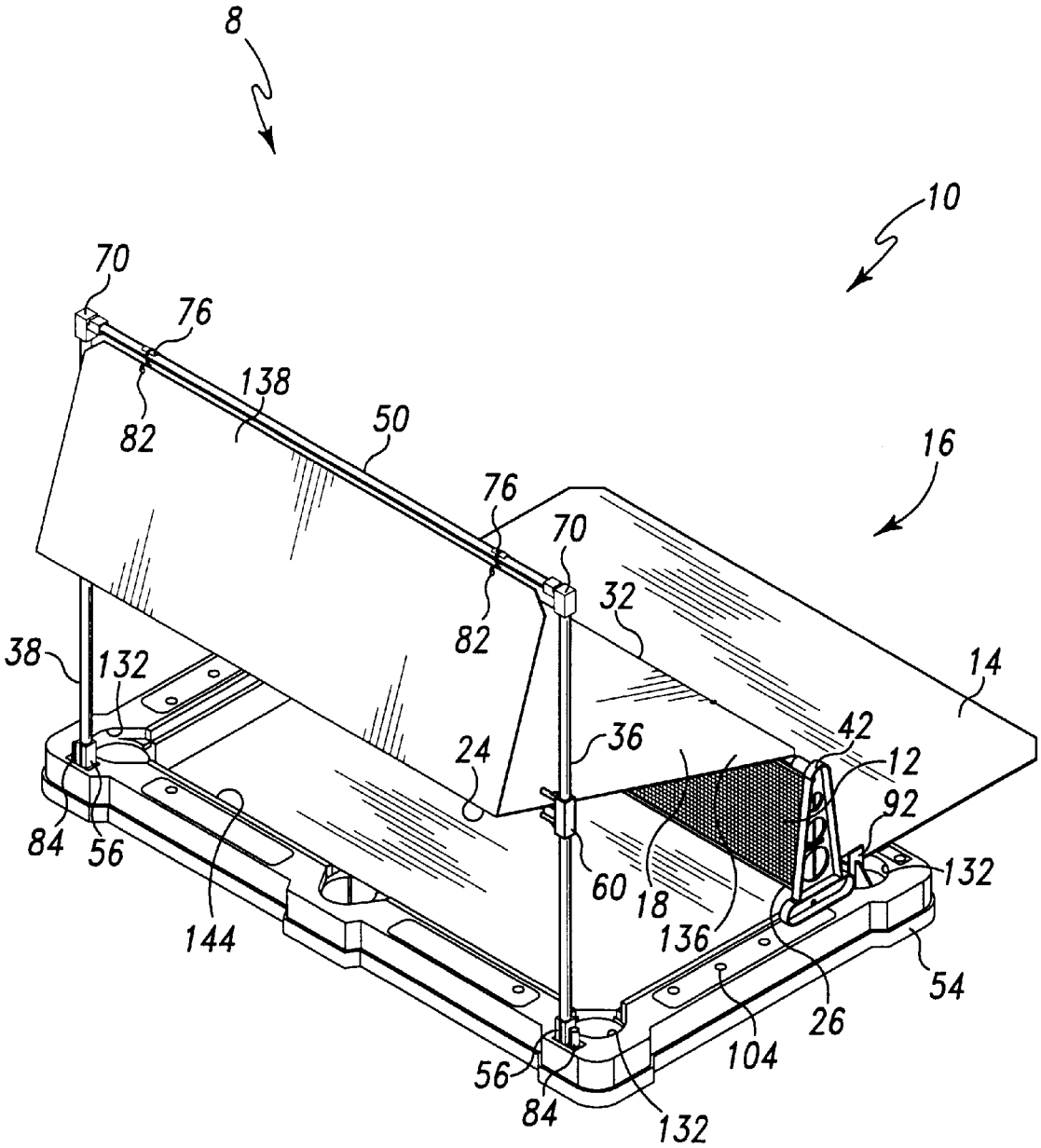
FIG. 2 is a rear perspective view of the table tennis assembly of FIG. 1.
Figure 3:
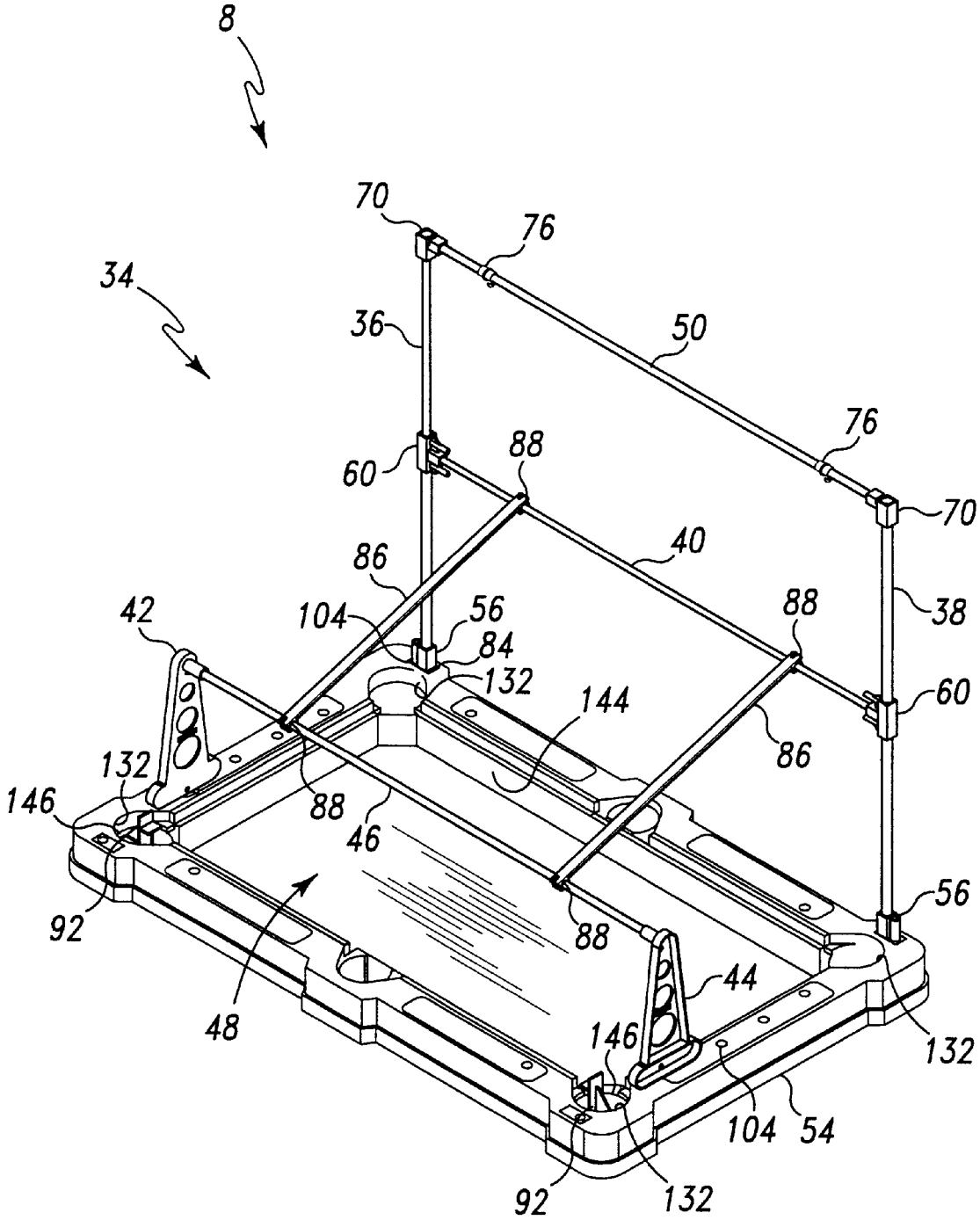
FIG. 3 is a view similar to that of FIG. 1, with the lower wall segment, the upper wall segment, the lower playing surface, and the net removed for clarity of description.
Figure 4:
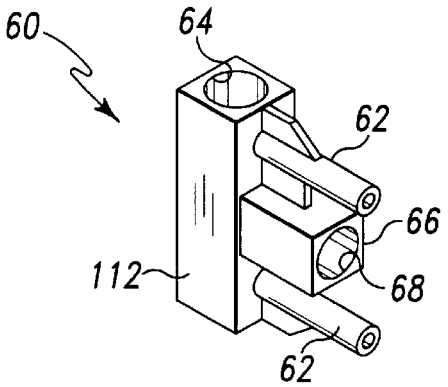
FIG. 4 is a perspective view of a clip used in the table tennis assembly of FIG. 1.
Figure 7:
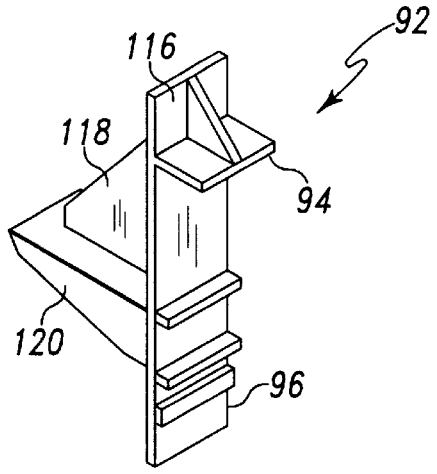
FIG. 7 is a perspective view of a bracket used in the table tennis assembly of FIG. 1.
Figure 5:
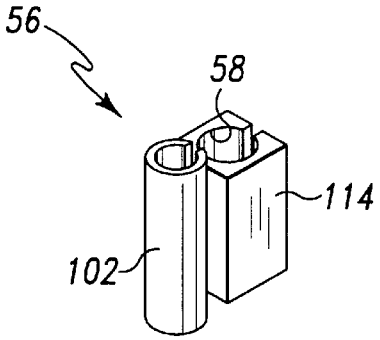
FIG. 5 is a perspective view of an adapter used in the table tennis assembly of FIG. 1.
Figure 8:
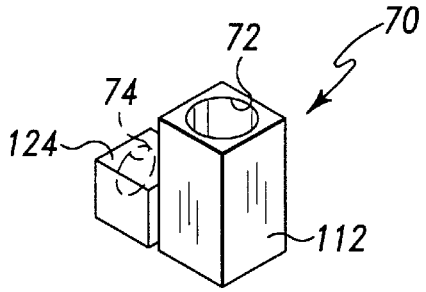
FIG. 8 is a perspective view of a support adapter used in the table tennis assembly of FIG. 1.
Figure 6:
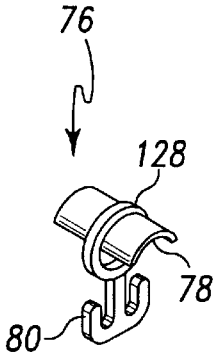
FIG. 6 is a perspective view of a hanger used in the table tennis assembly of FIG. 1.
Figure 9:
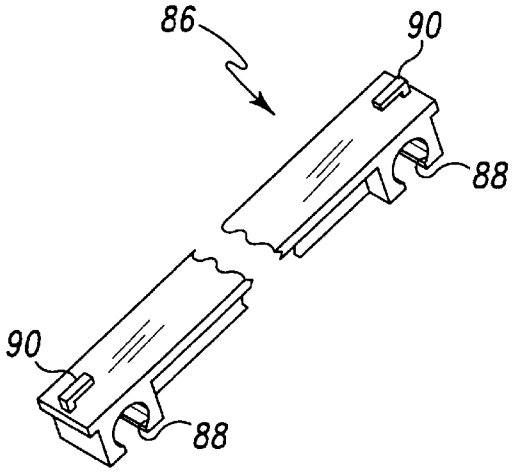
FIG. 9 is a fragmentary perspective view of a rail used in the table tennis assembly of FIG. 1.

As shown in FIGS. 1–3, table tennis assembly 10 includes a multipurpose game base 54, a lower wall segment 136, an upper wall segment 138, a lower playing surface 14, an upper playing surface 18, a return surface 22, a net 12, and a support assembly 34 (see FIG. 3). Multipurpose game base 54 has a number of holes 104, pockets 132, and rectangular depressions 84 (see FIG. 11) defined therein. Multipurpose game base 54 also has a central cavity 144 defined therein.

As shown in more detail in FIG. 3, support assembly 34 includes a first left vertical support 36, a second left vertical support 42, a first right vertical support 38, a second right vertical support 44, a first horizontal support 40, a second horizontal support 46, a third horizontal support 50, and a pair of rails 86. Support assembly 34 also includes a pair of support adapters 70, a pair of hangers 76, a pair of clips 60, a pair of adapters 56, and a pair of brackets 92.

Referring now to FIGS. 4–9, each clip 60 (see FIG. 4) includes a body 112 having a stud 66 and a pair of extensions 62 extending therefrom. A passageway 64 extends through body 112, and a hole 68 is defined in stud 66. Each adapter 56 (see FIG. 5) includes a body 114 having a boss 102 attached thereto. Body 114 has a hole 58 extending therethrough. Each hanger 76 (see FIG. 6) includes a ring member 128 attached to a bearing member 78. Each hanger 76 also includes a hook 80 attached to ring member 128. Each bracket 92 (see FIG. 7) includes a plate 116 having a flange 94 extending therefrom and a foot portion 96 attached thereto. Plate 116 also has a flange 120 extending therefrom and a rib 118 secured to flange 120 and plate 116. Each support adapter 70 (see FIG. 8) includes a body 122 having a stud 124 extending therefrom. Body 122 has a hole 72 extending therethrough, and stud 124 has a hole 74 defined therein. Each rail 86 (see FIG. 9) has a pair of tabs 90 and a pair of snap members 88 attached thereto.

Figure 10:
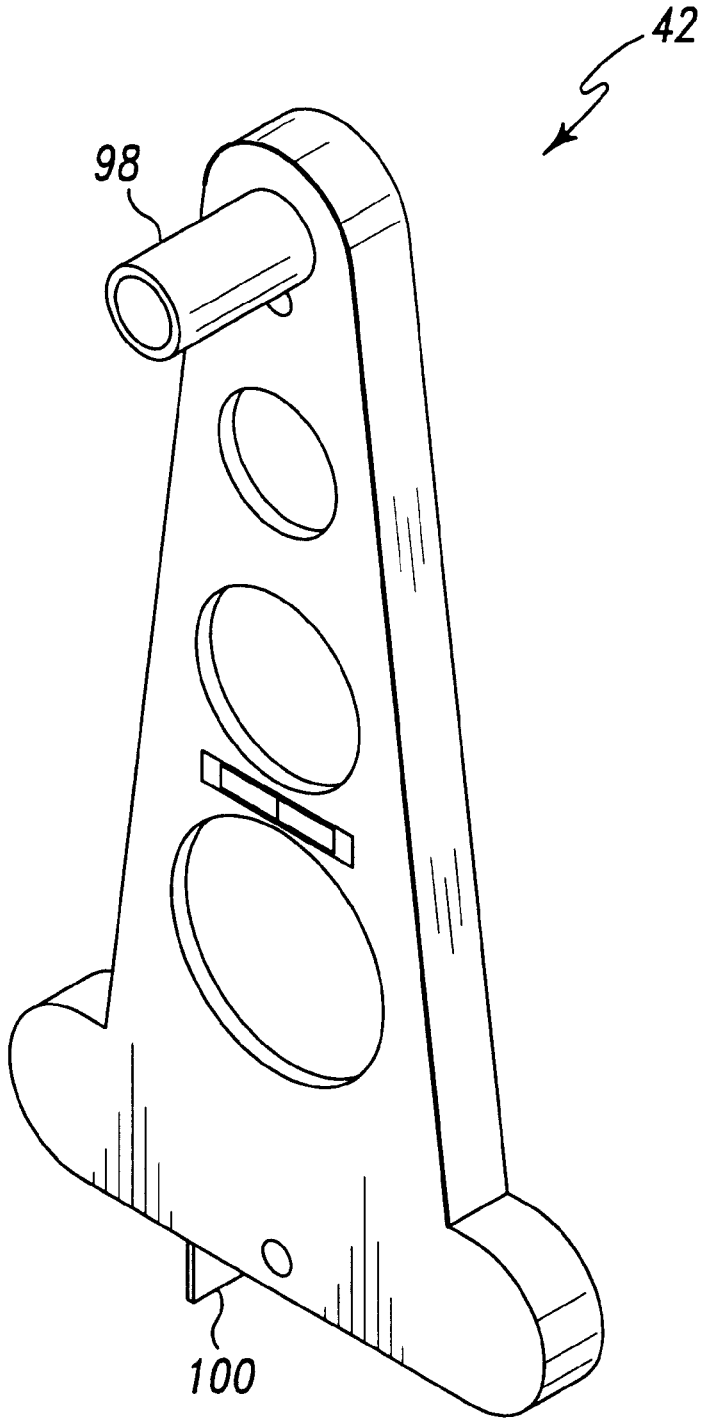
FIG. 10 is a perspective view of a right vertical support used in the table tennis assembly of FIG. 1.

As shown in FIG. 10, second left vertical support 42 includes a boss 98 and a plug 100 extending therefrom. It should be understood that second right vertical support 44 is substantially identical to second left vertical support 42 (i.e. second right vertical support 44 includes a boss 98 and a plug 100 extending therefrom).

Referring now to FIGS. 3–9, support adapter 70 is positioned relative to first left vertical support 36 such that an end of first left vertical support 36 is positioned in hole 72 of support adapter 70. In addition, the other end of first left vertical support 36 is positioned in hole 58 of adapter 56. Clip 60 is positioned relative to first left vertical support 36 such that first left vertical support 36 extends through passageway 64 of clip 60, and clip 60 is interposed between support adapter 70 and adapter 56. First left vertical support 36 is then positioned relative to multipurpose game base 54 such that a portion of body 114 of adapter 56 is located within rectangular depression 84 and boss 102 extends into hole 104 so as to secure first left vertical support 36 to multipurpose game base 54.

It should be understood that the other support adapter 70, clip 60, and adapter 56 are secured to first right vertical support 38 in a substantially identical manner as that described above for first left vertical support 36. In addition, it should be understood that first right vertical support 38 is attached to multipurpose game base 54 in a substantially identical manner as previously described above for first left vertical support 36 such that first right vertical support 38 is positioned in an opposing relationship with first left vertical support 36 as shown in FIG. 3.

Third horizontal support 50 is positioned relative to the pair of hangers 76 such that third horizontal support 50 extends through ring member 128 and is positioned in contact with bearing member 78. Third horizontal support 50 is then interposed between first left vertical support 36 and first right vertical support 38 such that one end of third horizontal support 50 is located within hole 74 defined in the support adapter 70 attached to first left vertical support 36, and the other end of third horizontal support 50 is located in hole 74 defined in the support adapter 70 secured to first right vertical support 38. In a similar manner, first horizontal support 40 is interposed between first left vertical support 36 and first right vertical support 38 such that one end of first horizontal support 40 is located within hole 68 of the clip 60 attached to first left vertical support 36 and the other end of first horizontal support 40 is located within hole 68 of the clip 60 secured to first right vertical support 38.

Second left vertical support 42 is positioned relative to multipurpose game base 54 such that plug 100 (see FIG. 10) of second left vertical support 42 is located within a hole 104. Positioning plug 100 in the above described manner secures second left vertical support 42 to multipurpose game base 54. Second right vertical support 44 is secured to multipurpose game base 54 in a substantially identical manner as described above for second left vertical support 42 such that second right vertical support 44 is in an opposing relationship with second left vertical support 42.

Second horizontal support 46 is interposed between second left vertical support 42 and second right vertical support 44 such that one end of second horizontal support 46 is positioned within boss 98 (see FIG. 10) of second left vertical support 42 and the other end of second horizontal support 46 is positioned within boss 98 of second right vertical support 44 as shown in FIG. 3.

It should be appreciated that locating first horizontal support 40, second horizontal support 46, and third horizontal support 50 in the above described manner (i) positions third horizontal support 50 at a greater vertical height relative to first horizontal support 40 and (ii) positions first horizontal support 40 at a greater vertical height relative to second horizontal support 46.

Each rail 86 is then interposed between first horizontal support 40 and second horizontal support 46 such that first horizontal support 40 and second horizontal support 46 each extend through each snap hole 88 of rails 86 as shown in FIG. 3.

Each bracket 92 is positioned within a pocket 132 defined in multipurpose game base 54 such that foot portion 96 of each bracket 92 extends through a T-shaped slot (not shown) defined in a floor (not shown) of pocket 132. In addition, each bracket 92 is positioned within a pocket 132 such that flange 120 contacts a sidewall 146 of pocket 132 thereby securing bracket 92 to multipurpose game base 54.

Referring now to FIG. 1, net 12 is secured in a space 48 (see also FIG. 3) between second left vertical support 42 and second right vertical support 44 such that net 12 extends therebetween and is secured below second horizontal support 46 (see FIG. 3). It should be understood that net 12 is secured to second left vertical support 42 and second right vertical support 44 by any appropriate means such as tying net 12 to second left vertical support 42 and second right vertical support 44 with a number of strings (not shown) extending from net 12.

Lower playing surface 14 is positioned relative to multipurpose game base 54 such that lower playing surface 14 is interposed between multipurpose game base 54 and flanges 94 extending from brackets 92. It should be understood that positioning the lower playing surface 14 in the previously described manner secures lower playing surface 14 to multipurpose game bas 54 such that (i) lower playing surface 14 is positioned on a first side 16 of net 12 and (ii) a lower edge 26 of net 12 is positioned adjacent to a rear edge 28 of lower playing surface 14.

Lower wall segment 136 is constructed from a printed paper board material available from Yick Po Printing Products FTY, located in Dougguan, Tang Xia Shui Wei Chun, China as catalogue number 4811 3100. Lower wall segment 136 is positioned between first horizontal support 40 (see FIG. 3) and second horizontal support 46 (see FIG. 3) such that lower wall segment 136 rests on rails 86 (see FIG. 3). In addition, lower wall segment 136 is positioned relative to rails 86 such that edges 140 and 142 of lower wall segment 136 are located under tabs 90 of rails 86. It should be appreciated that positioning lower wall segment 136 in the above described manner secures lower wall segment 136 to rails 86 and thus support assembly 34.

Upper wall segment 138 is also constructed from the printed paper board material available from Yick Po Printing Products FTY, located in Dougguan, Tang Xia Shui Wei Chun, China as catalogue number 4811 3100. Upper wall segment 138 is positioned relative to third horizontal support 50 such that hooks 80 of each hanger 76 extends through apertures 82 (see FIG. 2) defined in upper wall segment 138. Upper wall segment 138 is further positioned relative to support assembly 34 such that a portion 148 of upper wall segment 138 is positioned over edge 142 of lower wall segment 136 and is interposed between extension 62 and stud 66 of each clip 60. It should be appreciated that positioning upper wall segment 138 in the above described manner secures upper wall segment 138 to support assembly 34. In addition, it should be understood that lower wall segment 136 and the portion 148 of upper wall segment 138 that extends over lower wall segment 136 defines upper playing surface 18 such that upper playing surface 18 is (i) positioned on a second side 52 of net 12 and (ii) is supported by first horizontal support 40 (see FIG. 3) and second horizontal support 46 (see FIG. 3). Moreover, upper playing surface 18 is located such that (i) an upper edge 30 of net 12 is positioned adjacent to a front edge 32 of upper playing surface 18, (ii) front edge 32 of upper playing surface 18 is positioned adjacent to second horizontal support 46 (see FIG. 3), and (iii) upper playing surface 18 is at a height above lower playing surface 14.

A portion of upper wall segment 138 defines a return surface 22. Specifically, the portion of upper wall segment 138 which extends from a rear edge 24 of upper playing surface 18 and is supported on third horizontal support 50 defines return surface 22. Upper playing surface 18 is positioned relative to return surface such that upper playing surface 18 is interposed between return surface 22 and lower playing surface 14.

An important aspect of constructing table tennis assembly 10 in the above described manner is that upper playing surface 18 is oriented to form a downward slope which extends from rear edge 24 of upper playing surface 18 to front edge 32 of upper playing surface 18. Therefore, it should be appreciated that upper playing surface 18 is oriented in relation to net 12 and lower playing surface 14 such that a ping pong ball 20 rolling on upper playing surface 18 toward lower playing surface 14 will be directed (i) over net 12 and (ii) onto lower playing surface 14 after ping pong ball 20 rolls off of upper playing surface 18.

Typically, a game of table tennis is played on table tennis assembly 10 by having a first player (not shown) strike ping pong ball 20 with a paddle 150 such that ping pong ball 20 is advanced through the air and strikes return surface 22. Striking return surface 22 causes ping pong ball 20 to bounce off of return surface 22 and be directed toward upper playing surface 18 such that ping pong ball 20 rolls on upper playing surface 18 toward lower playing surface 14. Rolling on upper playing surface 18 toward lower playing surface 14 causes ping pong ball 20 to be directed (i) over net 12 and (ii) onto lower playing surface 14 after ping pong ball 20 rolls off of upper playing surface 18. After ping pong ball 20 rolls off of upper playing surface 18, ping pong ball 20 drops from upper playing surface 18 onto lower playing surface 14 such that ping pong ball 20 bounces off of lower playing surface 14 and can be struck again by another paddle 150 being utilized by a second player so as to repeat the above described process.

An important aspect of the present invention is that the spatial relationship between upper playing surface 18 and return surface 22 functions to slow the velocity of ping pong ball 20 as ping pong ball 20 comes into contact with return surface 22 and upper playing surface 18. In addition, the material used to construct upper wall segment 138 and lower wall segment 136 functions to slow the velocity of ping pong ball 20 as ping pong ball 20 comes into contact with return surface 22 and upper playing surface 18. Slowing down the velocity of ping pong ball 20 greatly increases the reaction time the players have to react and return an "in play" ping pong ball 20. This increase in reaction time increases the volleying. Increasing the volleying enhances the realism and competitive nature of table tennis assembly 10 and thus increases its entertainment value while still allowing table tennis assembly 10 to be a relatively small portable game.

BOWLING ASSEMBLY

Figure 11:
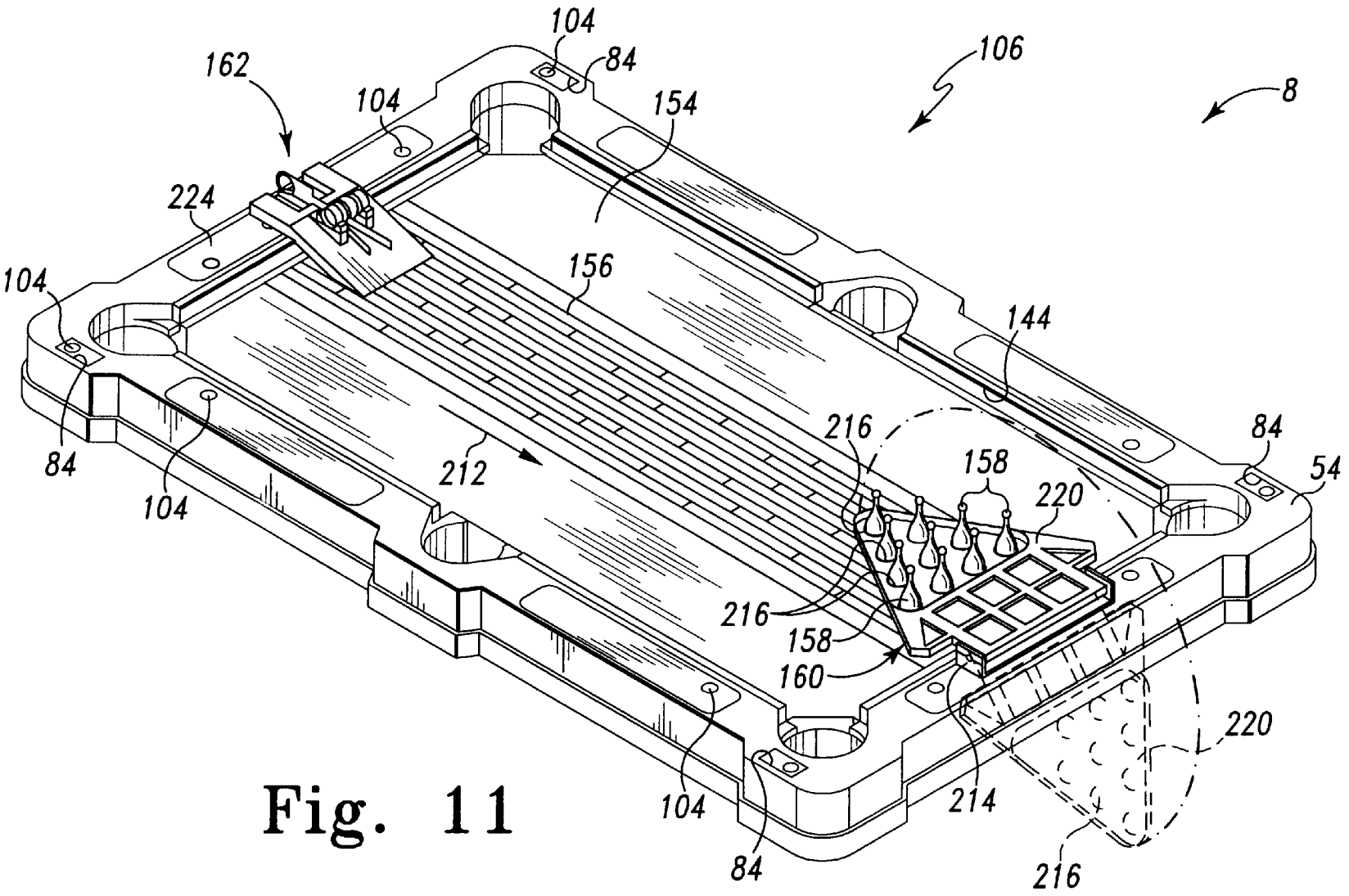
FIG. 11 is a perspective view of a bowling assembly which incorporates the features of the present invention therein.
Figure 12:
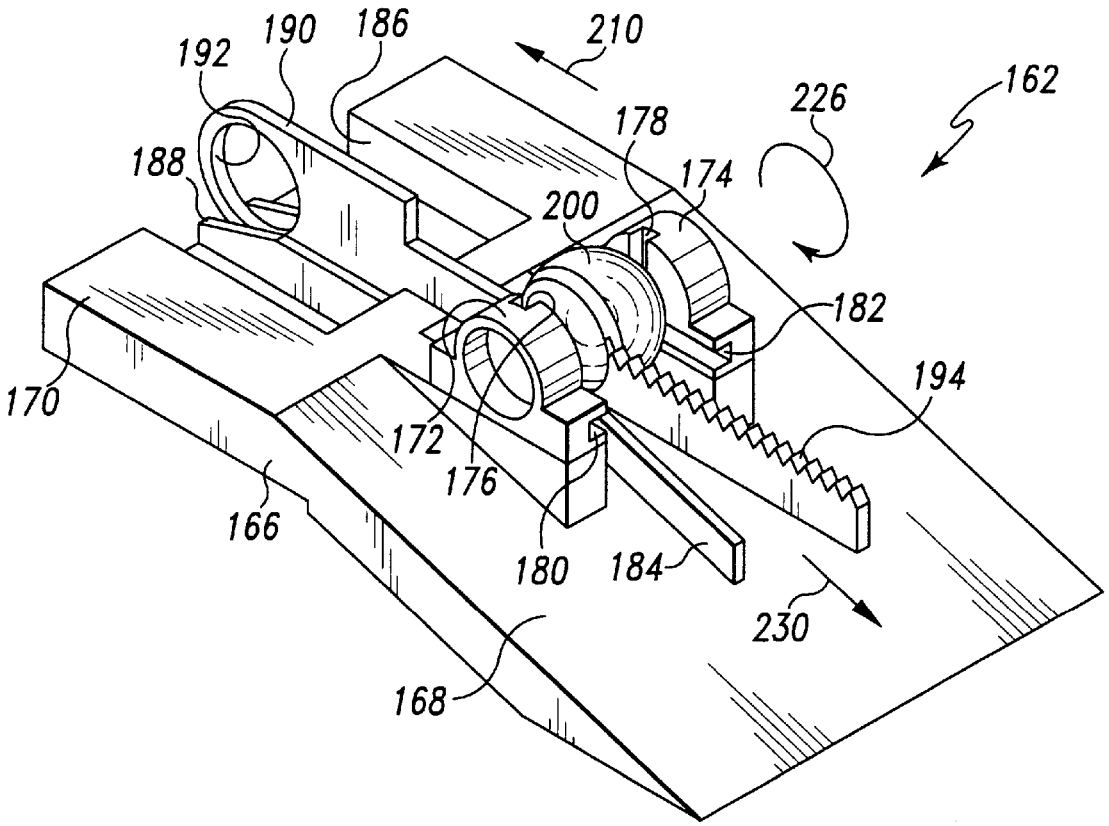
FIG. 12 is a perspective view of a launching assembly of the bowling assembly of FIG. 11.
Figure 13:
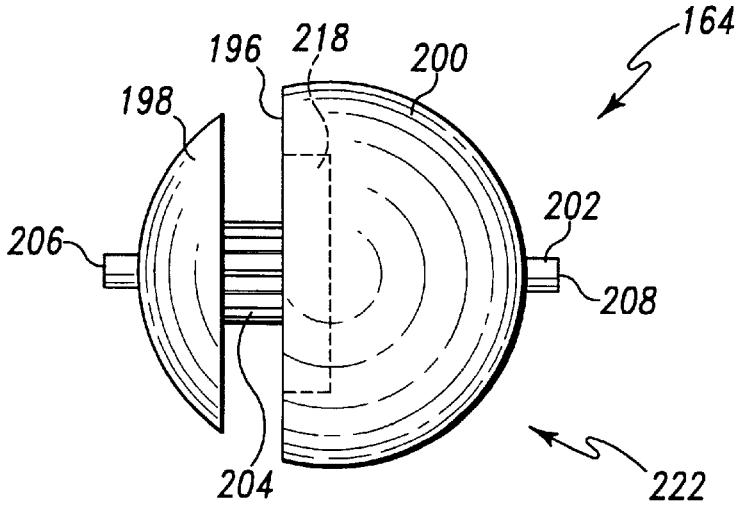
FIG. 13 is a side elevational view of a bowling ball used in the bowling assembly of FIG. 11.

As shown in FIGS. 11, 12, and 13, bowling assembly 106 includes multipurpose game base 54, a support plate 154, an alley member 156, a pin setter 160, a launching assembly 162, and a bowling ball 164. As shown in FIG. 11, support plate 154 is positioned within central cavity 144 of multipurpose game base 54. Alley member 156 is placed on support plate 154 such that alley member 156 extends the length of support plate 154.

Pin setter 160 includes a bracket 214 pivotally attached to a positioning member 220. Positioning member 220 has a number pinholes 216 defined therein for receiving pins 158. Bracket 214 is secured to multipurpose game base 54 by positioning studs (not shown) extending from bracket 214 within holes 104 defined in multipurpose game base 54. It should be appreciated that positioning member 220 is positionable between a set position and a release position. Positioning member 220 is located in the set position when positioning member 220 is located directly over alley member 156 as shown in FIG. 11. Positioning member 220 is located in the release position when positioning member 220 is rotated relative to multipurpose game base 54 such that positioning member 220 is no longer located directly over alley member 156 as shown in phantom in FIG. 11.

As shown more clearly in FIG. 12, launching assembly 162 includes a platform 166 having an angled portion 168 and a flat portion 170. Launching assembly 162 also includes an end cavity 186 defined in flat portion 170. A key receptacle 188 is positioned within end cavity 186 and secured to platform 166. A right bracket 172 and a left bracket 174 are attached to platform 166 on angled portion 168 such that right bracket 172 and left bracket 174 are in an opposing relationship. Right bracket 172 has a right slot 176 and a right exit slot 180 defined therein. Left bracket 174 also has a left slot 178 and a right exit slot 182 defined therein. It should be understood that right slot 176 and right exit slot 180 intersect each other. It should also be understood that left slot 178 and left exit slot 182 also intersect each other. A support rib 184 is secured to angled portion 168 of platform 166 such that support rib 184 is in interposed between right bracket 172 and left bracket 174. Key 190 includes a serrated edge 194 and a finger hole 192 defined therein. Key 190 is positioned relative to platform 166 such that a portion of key 190 is located within key receptacle 188 and serrated edge 194 rest on support rib 184 interposed between right bracket 172 and left bracket 174.

Bowling ball 164 includes a ball portion 222 having a groove 196 defined therein. Groove 196 divides ball portion 222 into a left portion 198 and a right portion 200. Note that left portion 198 is smaller than right portion 200. Bowling ball 164 also includes a pinion 202 extending therethrough such that an end 206 extends out of left portion 198 and an end 208 extends out of right portion 200. Bowling ball 164 further includes a gear member 204 disposed around pinion 202 such that gear member 204 is positioned within groove 196. Bowling ball 164 also includes a weight 218 disposed around pinion 202 such that weight 218 is embedded within right portion 200.

To bowl utilizing bowling assembly 106 a first player (not shown) locates positioning member 220 in the setting position and then inserts pins 158 through pinholes 216. Once each pinhole 216 has a pin 158 contained therein, positioning member 220 is positioned in the release position as shown in phantom in FIG. 11. It should be appreciated that the design of pin setter 160 allows positioning member 220 to pivot back to the release position without disturbing the pins 158 located on alley member 156. Once positioning member 220 is located in the release position, pins 158 are positioned in the proper orientation to begin bowling. The first player then places bowling ball 164 relative to launching assembly 162 such that end 206 of pinion 202 is located within right slot 176 and end 208 of pinion 202 is located within left slot 178. Bowling ball 164 is further positioned relative to launching assembly 162 such that serrated edge 194 of key 190 is located within groove 196 of bowling ball 164. It should be understood that when serrated edge 194 is located within groove 196 serrated edge 194 meshingly engages gear member 204. Once bowling ball 164 is positioned relative to launching assembly 162 in the above described manner launching assembly 162 is positioned relative to multipurpose game base 54 such that flat portion 170 rests on an edge 224 of multipurpose game base 54 as shown in FIG. 11. Positioning launching assembly 162 in the aforementioned manner locates launching assembly 162 in an opposing relationship to pins 158.

Bowling ball 164 is launched from launching assembly 162 by placing a finger of the first player through finger hole 192 of key 190. The first player then pulls key 190 relative to platform 166 in the direction of arrow 210 (see FIG. 12). Pulling key 190 in the direction of arrow 210 causes bowling ball 164 to spin in a direction indicated by arrow 226 (see FIG. 12). Key 190 is further pulled in the direction of arrow 210 until serrated edge 194 is no longer positioned within groove 196. Once serrated edge 194 is no longer positioned in groove 196 bowling ball 164 drops down relative to right bracket 172 and left bracket 174 such that support rib 184 is positioned within groove 196. Bowling ball 164 then travels in the direction indicated by the arrow 230 such that end 206 and end 208 of pinion 202 exit right exit slot 180 and left exit slot 182, respectively. After launching bowling ball 164 from launching assembly 162 in the above described manner, bowling ball 164 to travels down alley member 156 in the direction of arrow 212 (see FIG. 11), until bowling ball 164 strikes a number of pins 158. After bowling ball 164 strikes pins 158, the pins 158 which have been knocked down by bowling ball 164 are removed from alley member 156. The first player then launches bowling ball 164 down alley member 156 once again in the above described manner to obtain a score (e.g. the number of pin knocked down) for that particular bowling cycle.

After the first player's second launch, pins 158 are collected and positioning member 220 is located in the set position. Pins 158 are then placed through pinholes 216. Once each pin hole 216 has a pin 158 therein positioning member 220 is located in the release position. The above described bowling cycle is then repeated by a second player. A number of the above described bowling cycles are repeated until a bowling game is completed.

An important aspect of bowling assembly 106 is that groove 196 defined in bowling ball 164 divides bowling ball 164 into relatively small left portion 198 and relatively large right portion 200. Dividing bowling ball 164 in the above described manner causes bowling ball 164 to curve or "hook" as bowling ball 164 travels down alley member 156 in the direction arrow 212. Causing bowling ball 164 to curve or "hook" in the above described manner requires a player utilizing bowling assembly 106 to carefully position launching assembly 162 relative to pins 158 so as to compensate for the curved path bowling ball 164 will take as bowling ball 164 travels down alley member 156. Therefore, it will be appreciated that having bowling ball 164 travel in a curved path as bowling ball 164 moves down alley member 156 increases the realism, the strategy involved, and the competitive nature of bowling assembly 106, and thus increases its entertainment value.

HOCKEY ASSEMBLY

Figure 14:
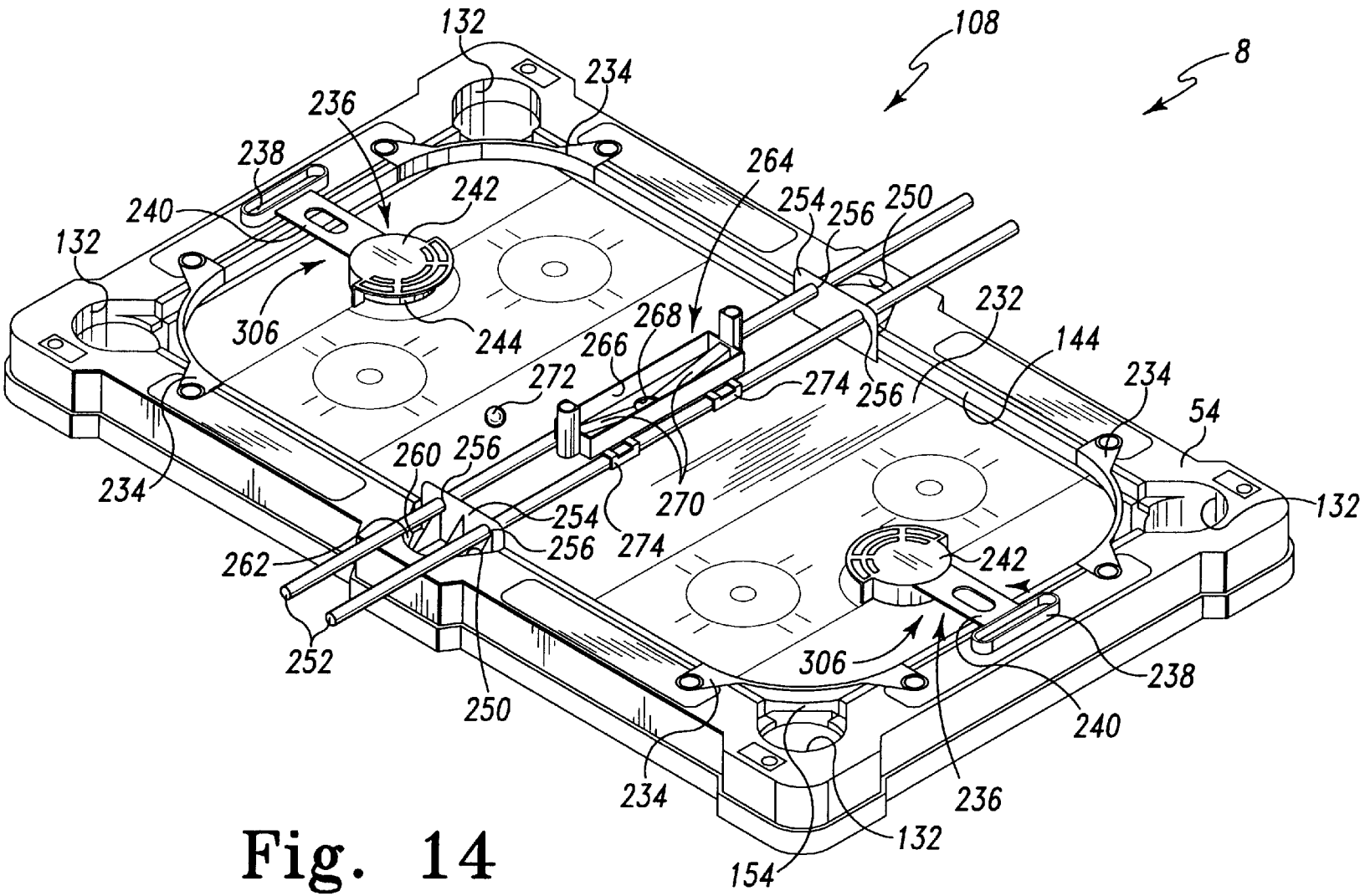
FIG. 14 is a perspective view of a hockey assembly which incorporates the features of the present invention therein.
Figure 15:
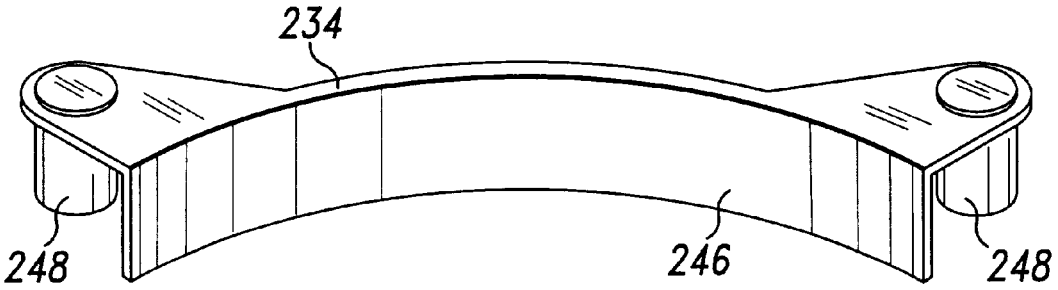
FIG. 15 is a perspective view of a guard of the hockey assembly of FIG. 14.

As shown in FIGS. 14, 15, 16, 17, and 18, hockey assembly 108 includes multipurpose game base 54, support plate 154, playing surface 232, a number of guards 234, a pair of goal assemblies 236, a pair of stick assemblies 276, and a face-off assembly 264. As shown in FIG. 14, support plate 154 is located in central cavity 144 and playing surface 232 is positioned on support plate 154.

Each goal assembly 236 includes an attachment member 238, a boom 240 extending from attachment member 238, a goal 242 attached to boom 240, and a bell 244 secured to goal 242. Each goal assembly 236 is positioned relative to multipurpose game base 54 such that studs (not shown) extending from attachment member 238 are positioned within holes 104 (see FIG. 3). In addition, each goal assembly 236 is positioned relative to multipurpose game base 54 such that goal 242 and bell 244 extend over playing surface 232. It should also be understood that goal assemblies 236 are positioned at opposite ends of multipurpose game base 54 such that goal assemblies 236 are positioned in an opposing relationship.

Figure 16:
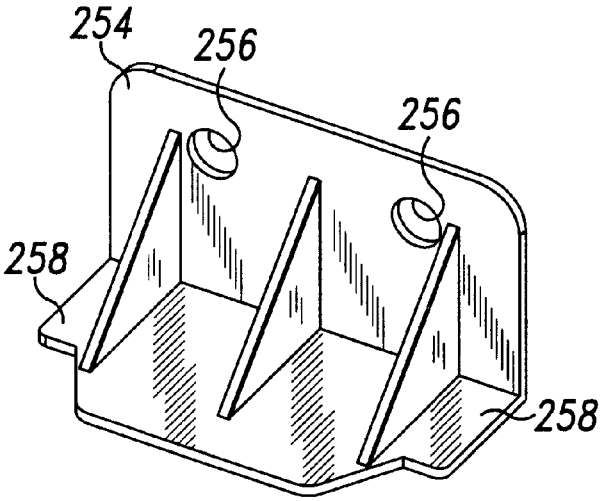
FIG. 16 is a perspective view of a side clip of the hockey assembly of FIG. 14.

Face-off assembly 264 includes a pair of side clips 254 each having a pair of holes 256 defined therethrough and a pair of flanges 258 extending therefrom (see FIG. 16). Face-off assembly 264 also includes a pair of support rods 252 and a rectangular receptacle 266. Rectangular receptacle 266 has a pair of inclined feed rails 270 attached thereto and four clamps 274 extending therefrom (note that only two clamps 274 are shown in FIG. 14). Rectangular receptacle 262 also has a aperture 268 defined therein such that aperture 268 is interposed between inclined feed rails 270.

Each side clip 254 is positioned adjacent to one side pocket 250 such that flanges 258 extending from side clip 254 are disposed within in a slot 260 defined in side wall 262 of side pocket 250. It should be understood that positioning side clip 254 in the previously described manner secures side clip 254 to multipurpose game base 54. Once both side clips 254 are positioned in the previously described manner, each support rod 252 is inserted through holes 256 of each side clip 254 such that support rods 252 are in a parallel relationship as shown in FIG. 14. Rectangular receptacle 266 is then positioned relative to support rods 252 such that each support rod 252 is disposed within a pair of clamps 274 extending from rectangular receptacle 266. It should be understood that positioning rectangular receptacle 266 in the aforementioned manner secures rectangular receptacle 266 to support rods 252.

One guard 234 is positioned adjacent to each pocket 132 such that studs 248 (see FIG. 15) extending from each guard 234 are located within holes 104 (see FIG. 3) defined in multipurpose game base 54. In addition each guard 234 is positioned relative to each pocket 132 such that guard surface 246 (see FIG. 15) faces away from pocket 132.

Figure 17:
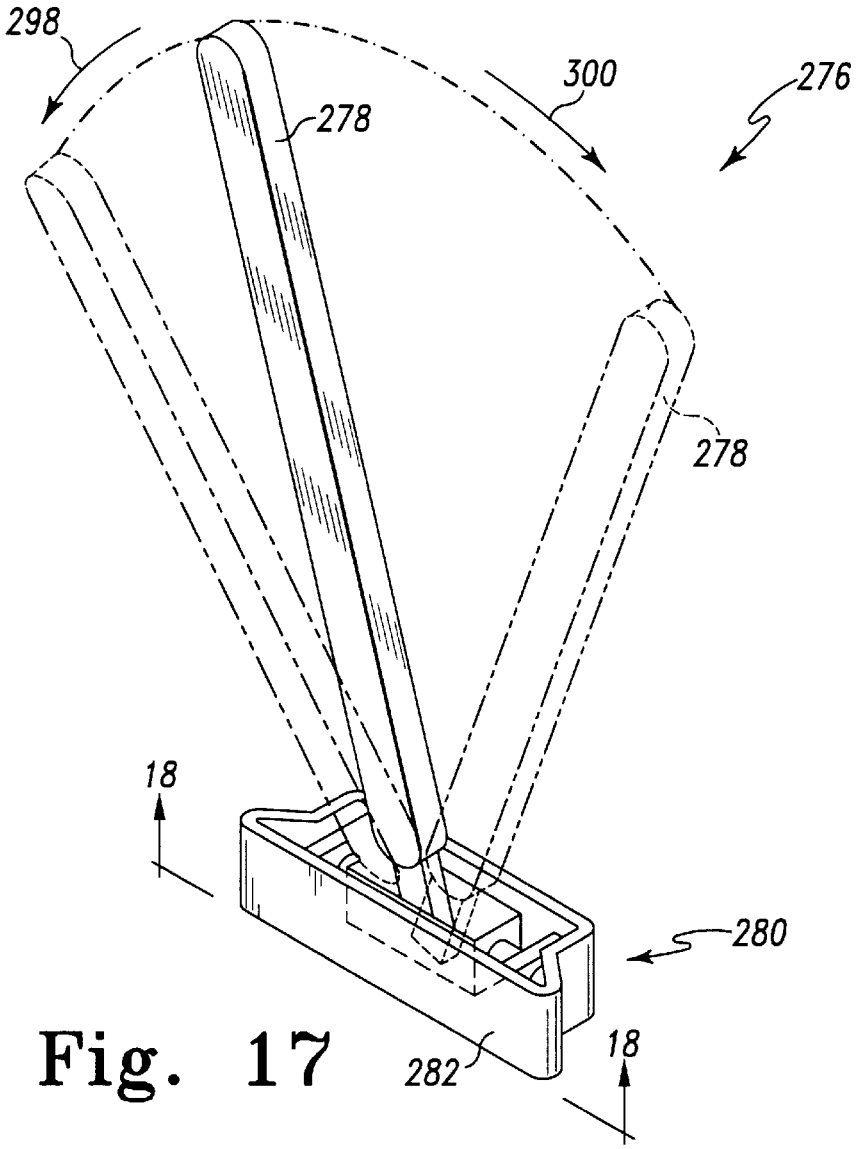
FIG. 17 is a perspective view of a stick assembly of the hockey assembly of FIG. 14 (note that the handle portion of the stick assembly is shown in phantom in two pivot positions)
Figure 18:
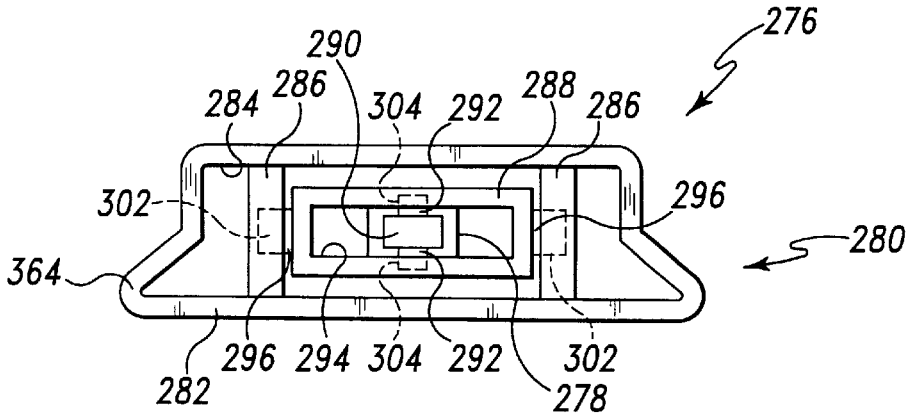
FIG. 18 is a view of the stick assembly of FIG. 17 taken along the line 18—18 as viewed in the direction of the arrows.

As shown in FIGS. 17 and 18, stick assembly 276 includes a handle portion 278 and a head portion 280. As shown in FIG. 18, head portion 280 defines a contact surface 282 and an interior space 284. Head portion 280 also has an edge 364 and a pair of cross bars 286 positioned within interior space 284 such that cross bars 286 are in a parallel relationship and attached to head portion 280. Stick assembly 266 also includes an undercarriage 288 having a pair of studs 296 extending therefrom. Undercarriage 288 defines an inner space 294. Undercarriage 288 is positioned within inner space 284 of head portion 280 such that each stud 296 is located within a hole 302 defined in each cross bar 286. Positioning undercarriage 288 in the above described manner pivotally secures undercarriage 288 to head portion 280.

An end 290 of handle portion 278 is located within inner space 294 of undercarriage 288 such that each stud 292 extending from end 290 is located within a hole 304 defined in undercarriage 288. Positioning handle portion 278 in the above described manner pivotally secures handle portion 278 to undercarriage 288.

It should be appreciated that the above described construction of stick assembly 276 allows handle portion 278 to pivot relative to head portion 280. Specifically, handle portion 278 can pivot relative to head portion 280 in a direction indicated by arrow 298, and in a direction opposite to the direction indicated by arrow 298. In addition, handle portion 278 can pivot relative to head portion 280 in a direction indicated by arrow 300, and in a direction opposite to the direction indicated by arrow 300.

Typically a game of hockey is played on hockey assembly 108 by having a first player (not shown) drop a ball 272 into rectangular receptacle 266 such that ball 272 rolls down an incline feed rail 270, passes through aperture 268 and drops onto playing surface 232. At the same time, first player places his or her stick assembly 276 relative to playing surface 232 such that (i) the entire edge 364 (see FIG. 18) of head portion 280 is in contact with playing surface 232 and (ii) contact surface 282 and playing surface 232 define a right angle. Simultaneously, an opposing second player (not shown) also places his or her stick assembly 276 relative to playing surface 232 as described above for the first player. Once ball 272 drops onto playing surface 232 either the first player or the second player attempts to strike ball 272 with contact surface 282 of his or her stick assembly 276 such that ball 272 is directed toward goal assembly 236 of the opposing player (i.e. the first player or the second player). At the same time, the opposing player attempts to block ball 272 from striking bell 244 of his or her goal assembly 236 by utilizing contact surface 282 of his or her stick assembly 276. Ball 272 is continuously struck back and forth between goal assemblies 236 in the above described manner until one player is successful in striking bell 244 of the opposing player's goal assembly 236. At this point ball 272 is removed from playing surface 232 and a new "face-off" is initiated by placing ball 272 into rectangular receptacle 266 as previously described. The hockey game continues in the aforementioned manner until one player is declared a winner by striking bell 244 of the opposing player's goal assembly 236 an appropriate number of times.

Having handle portion 278 capable of pivoting relative to head portion 280 is an important aspect of the present invention. In particular, having handle portion 278 capable of pivoting in the aforementioned manner ensures that head portion 280 remains in contact with playing surface 232 such that the right angle is maintained between contact surface 282 and playing surface 232. Having a right angle between contact surface 282 and playing surface 232 ensures that when contact surface 282 strikes ball 272 during a hockey game, ball 272 remains on playing surface 232 and does not fly out of central cavity 144 of multipurpose game base 54. Keeping ball 272 in contact with playing surface 232 and located within central cavity 144 ensures that a hockey game can be continuously played without any interruptions between goal scoring.

Additionally, it should be understood that having both goals 242 extend out over playing surface 232 such that a playing space 306 (see FIG. 14) is defined between each goal 242 and multipurpose game base 54 allows a player to "play" or strike ball 272 with stick assembly 276 when ball 272 is behind goal 242. Being able to strike ball 272 when ball 272 is located behind goal 242 simulates an actual hockey game where a puck can be played from behind a goalie. Both of these factors, that is, (i) ensuring that ball 272 remains on playing surface 232 and (ii) being able to play ball 272 from behind each goal 242 adds to the realism and thus the entertainment value of hockey assembly 108.

BASKETBALL ASSEMBLY

Figure 19:
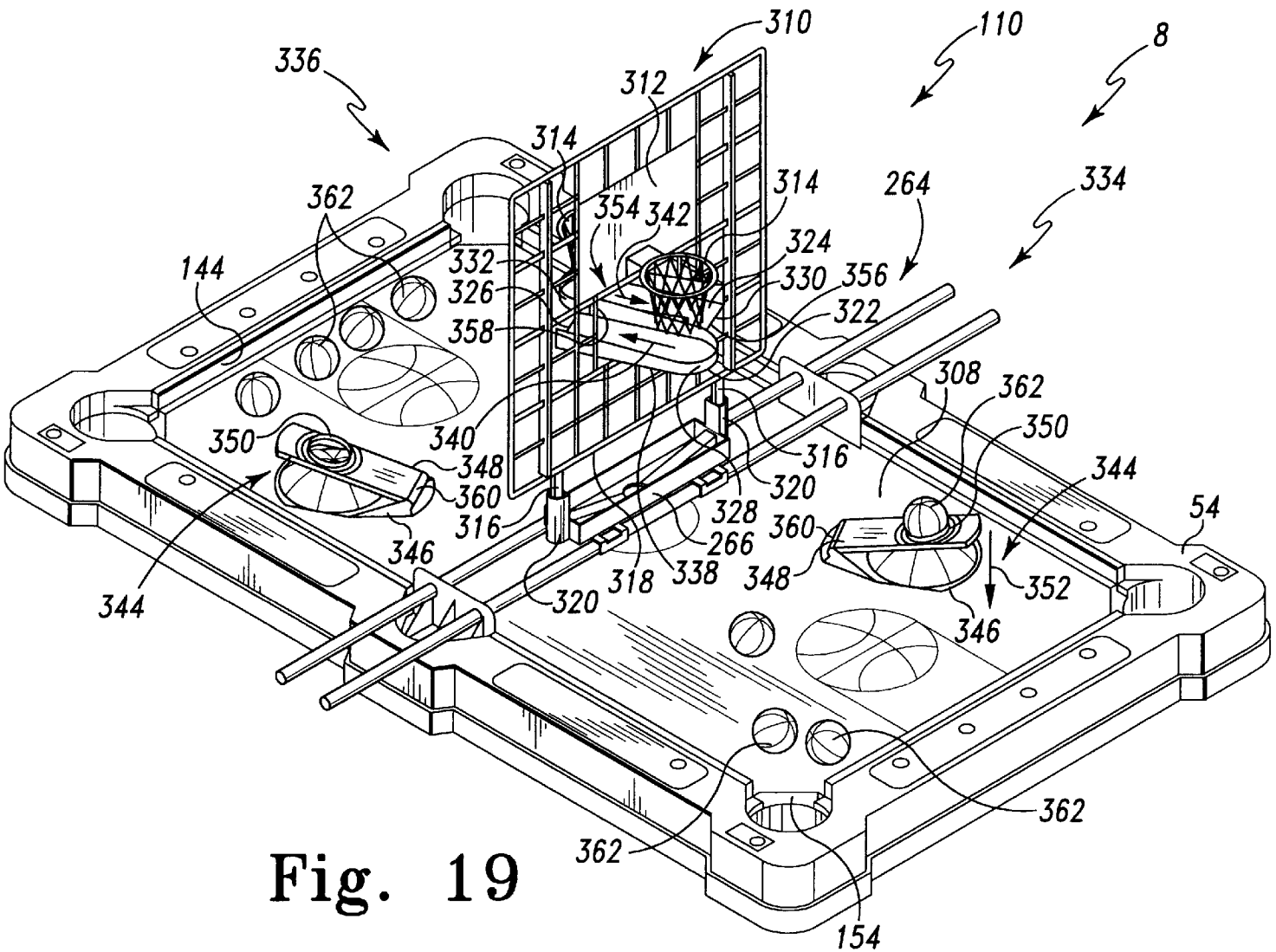
FIG. 19 is a perspective view of a basketball assembly which incorporates the features of the present invention therein.

As shown in FIG. 19, basketball assembly 10 includes multipurpose game base 54, support plate 154, a court surface 308, face off assembly 264, pair of shooting assemblies 344, and basket assembly 310. Support plate 154 is located in central cavity 144 of multipurpose game base 54 and court surface 308 is positioned on support plate 154. Face off assembly 264 is secured to multipurpose game base 54 in an identical manner as described above in reference to hockey assembly 108.

Basket assembly 310 includes a backboard 312, a pair of baskets 314, and a dual ball return 354. Backboard 312 has a pair of attachment rods 316 extending from a lower edge 318 thereof. Backboard 312 is positioned relative to rectangular receptacle 266 such that each attachment rod 316 is located within a receptacle secured to rectangular receptacle 266. Positioning backboard 312 in the above described manner secures backboard 312 to rectangular receptacle 266 such that backboard 312 divides court surface 308 into first court surface 334 and a second court surface 336.

One basket 314 is secured to backboard 312 such that basket 314 faces first court surface 334. The other basket 314 is secured to backboard 312 such that basket 314 faces second court surface 336.

Dual ball return 354 includes a left slide 322 and a right slide 324. Left ide 322 has a clip (not shown) extending from a bottom surface 338 thereof. Right slide 324 also has a clipped left (not shown) extending from a bottom surface 356 thereof. Left slide 322 has an open end 326 and a closed end 328. Right slide 324 also has an open end 330 and a closed end 332. Left slide 322 is secured to backboard 312 such that left slide extends through aperture 358 and open end 326 is positioned above second court surface 336 while closed end 328 is positioned above first court surface 334.

Right slide 324 is attached to backboard 312 utilizing the clip extending therefrom such that right slide 324 extends through aperture 358 such that closed end 332 is positioned above second court surface 336 and open end 330 is positioned above first court surface 334. Left slide 322 and right slide 324 are further positioned relative to backboard 312 such that left slide 322 has a slope extending downwardly from closed end 328 to open end 326 and right slide 324 has a slope extending downwardly from closed end 332 to open end 330.

Each shooting assembly 344 includes a platform 346 and a spring plate 348 having a ball receptacle 350 defined therein. Spring plate 348 has an end 360 pivotally attached to platform 346 such that spring plate 348 can move relative to platform 346 in a direction indicated by an arrow 352 and in a direction opposite to the direction indicated by arrow 352. In addition, a spring (not shown) is interposed between platform 346 and spring plate 348 such that the spring biases spring plate 348 away from platform 346. One shooting assembly 334 is positioned on first court surface 344 in contact with court surface 308 while the other shooting assembly 334 is positioned on second court surface 336 in contact with court surface 308.

Typically a game of basketball is initiated utilizing basketball assembly 110 by placing an equal number of basketballs 362 on first court surface 334 and second court surface 336. One basketball 362 is then positioned within ball receptacle 350 of each shooting assembly 344. Each player then depresses spring plate 348 in the direction of arrow 352 and then releases spring plate 348 such that spring plate 348 is quickly moved away from platform 346 and ball 362 is launched toward the appropriate basket 314 (i.e. the basket 314 located on the same side of backboard 312 that shooting assembly 344 is located). When a basketball 362 goes through basket 314 located on first court surface 344, basketball 362 will drop out of basket 314 and land adjacent to closed end 328 of left slide 322. After landing on slide 322 basketball 362 will roll down left slide 322 in a direction indicated by arrow 340 until basketball 362 rolls past open end 326 and drops onto court surface 308 on second court surface 336. Once this occurs, the player operating shooting assembly 344 located on first court surface 334 picks up another basketball 362 and places basketball 362 in ball receptacle 350 of shooting assembly 344 and attempts to shoot basketball 362 through basket 314 in the same manner as described above. While one player operates the shooting assembly 344 located on first court surface 334 an opposing player operates the shooting assembly 344 located on second court surface 336 in a substantially identical manner. That is the player operating shooting assembly 344 located on second court surface 336 places a basketball 362 into ball receptacle 350 and shoots basketball 362 toward the basket 314 located on second court surface 336. If basketball 362 goes through basket 314 located on second court surface 336, basketball 362 will drop through basket 314 and land on right slide 324 adjacent to closed end 332. Once basketball 362 is on right slide 324 in the above described manner, basketball 362 rolls down right slide 324 in the direction indicated by arrow 342 until basketball 362 passes open end 330 such that basketball 362 drops on court surface 308 on first court surface 334. The above described process continues until a player no longer has any basketballs 362 located on their respective court surface, that is, first court surface 334 or second court surface 336. Once a player no longer has any basketballs 362 located on their respective court surface, that player is declared the winner. In the alternative, the winner can be determined by the number of basketballs 362 passed through the respective basket 314 during a specified time period.

Having dual ball return 354 designed such that when a basketball 362 passes through the basket 314 located above first court surface 334 the same basketball 362 is put back into play on second court surface 336 (and vice versa) is an important aspect of the present invention. Specifically, this feature of basketball assembly 110 allows two players of basketball assembly 110 to directly compete against each other which enhances the entertainment value of the basketball assembly 110.

Furthermore, it should be appreciated that table tennis assembly 10, bowling assembly 106, hockey assembly 108, the pool assembly (not shown) and basketball assembly 110 can all be stored and carried in central cavity 144 of multipurpose game base 54. Therefore, game assembly 8 provides a small, portable, and very versatile game assembly which will hold the interest of a player for relatively long period of time.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A table tennis assembly, comprising:

a net;

a lower playing surface positioned on a first side of said net; and an upper playing surface positioned on a second side of said net, wherein said upper playing surface is oriented in relation to said net and said lower playing surface such that a ping pong ball rolling on said upper playing surface toward said lower playing surface will be directed (i) over said net and (ii) onto said lower playing surface after said ping pong ball rolls off of said upper playing surface, wherein a lower edge of said net is positioned adjacent to a rear edge of said lower playing surface, and wherein an upper edge of said net is positioned adjacent to a front edge of said upper playing surface.

2. The table tennis assembly of claim 1, further comprising a return surface, wherein:

said upper playing surface is interposed between said return surface and said lower playing surface, and said return surface extends upwardly from a rear edge of said upper playing surface.

3. The table tennis assembly of claim 1, further comprising a support assembly which positions said upper playing surface at a height above said lower playing surface, wherein said support assembly includes:

a first left vertical support, a first right vertical support, and a first horizontal support extending between said first left vertical support and said first right vertical support, said upper playing surface being supported on said first horizontal support.

4. The table tennis assembly of claim 3, wherein said support assembly further includes:

a second left vertical support, a second right vertical support, and a second horizontal support extending between said second left vertical support and said second right vertical support, said upper playing surface being further supported on said second horizontal support, wherein said first horizontal support is positioned at a greater vertical height relative to said second horizontal support whereby said upper playing surface is oriented to form a downward slope which extends from said rear edge of said upper playing surface to a front edge of said upper playing surface.

5. The table tennis assembly of claim 4, wherein:

said net is secured in a space defined between said second left vertical support and said second right vertical support, and said net is further secured below said second horizontal support.

6. The table tennis assembly of claim 4 wherein:

said front edge of said upper playing surface is positioned adjacent to said second horizontal support.

7. A table tennis assembly, comprising:

a net;

a lower playing surface positioned on a first side of said net; and an upper playing surface positioned on a second side of said net;

wherein said upper playing surface is oriented in relation to said net and said lower playing surface such that a ping pong ball rolling on said upper playing surface toward said lower playing surface will be directed (i) over said net and (ii) onto said lower playing surface after said ping pong ball rolls off of said upper playing surface;

further comprising a support assembly which positions said upper playing surface at a height above said lower playing surface, wherein said support assembly includes (i) a first left vertical support, (ii) a first right vertical support, and (iii) a first horizontal support extending between said first left vertical support and said first right vertical support, said upper playing surface being supported on said first horizontal support;

wherein said support assembly further includes (i) a second left vertical support, (ii) a second right vertical support, and (iii) a second horizontal support extending between said second left vertical support and said second right vertical support, said upper playing surface being further supported on said second horizontal support;

wherein said first horizontal support is positioned at a greater vertical height relative to said second horizontal support whereby said upper playing surface is oriented to form a downward slope which extends from said rear edge of said upper playing surface to a front edge of said upper playing surface;

wherein (i) said net is secured in a space defined between said second left vertical support and said second right vertical support, and (ii) said net is further secured below said second horizontal support; and further comprising a return surface, wherein (i) said upper playing surface is interposed between said return surface and said lower playing surface, (ii) said return surface extends upwardly from said rear edge of said upper playing surface, (iii) said support assembly further includes a third horizontal support extending between said first left vertical support and said first right vertical support, and (iv) said return surface being supported on said third horizontal support.

8. The table tennis assembly of claim 7, wherein said third horizontal support is positioned vertically above said first horizontal support.

9. A table tennis assembly, comprising:

a net;

a lower playing surface positioned on a first side of said net;

an upper playing surface positioned on a second side of said net, said upper playing surface being oriented in relation to said net and said lower playing surface such that a ping pong ball rolling on said upper playing surface toward said lower playing surface will be directed (i) over said net and (ii) onto said lower playing surface after said ping pong ball rolls off of said upper playing surface; and a return surface which extends upwardly from a first rear edge of said upper playing surface, wherein a lower edge of said net is positioned adjacent to a second rear edge of said lower playing surface, and wherein an upper edge of said net is positioned adjacent to a front edge of said upper playing surface.

10. The table tennis assembly of claim 9, further comprising a support assembly which positions said upper playing surface at a height above said lower playing surface, wherein said support assembly includes:

a first left vertical support, a first right vertical support, and a first horizontal support extending between said first left vertical support and said first right vertical support, said upper playing surface being supported on said first horizontal support.

11. The table tennis assembly of claim 10, wherein said support assembly further includes:

a second left vertical support, a second right vertical support, and a second horizontal support extending between said second left vertical support and said second right vertical support, said upper playing surface being further supported on said second horizontal support, wherein said first horizontal support is positioned at a greater vertical height relative to said second horizontal support whereby said upper playing surface is oriented to form a downward slope which extends from said first rear edge of said upper playing surface to a front edge of said upper playing surface.

12. The table tennis assembly of claim 11, wherein:

said net is secured in a space defined between said second left vertical support and said second right vertical support, and said net is further secured below said second horizontal support.

13. The table tennis assembly of claim 11 wherein:

said front edge of said upper playing surface is positioned adjacent to said second horizontal support.

14. A table tennis assembly, comprising:

a net;

a lower playing surface positioned on a first side of said net;

an upper playing surface positioned on a second side of said net, said upper playing surface being oriented in relation to said net and said lower playing surface such that a ping pong ball rolling on said upper playing surface toward said lower playing surface will be directed (i) over said net and (ii) onto said lower playing surface after said ping pong ball rolls off of said upper playing surface; and a return surface which extends upwardly from a first rear edge of said upper playing surface;

further comprising a support assembly which positions said upper playing surface at a height above said lower playing surface, wherein said support assembly includes (i) a first left vertical support, (ii) a first right vertical support, and (iii) a first horizontal support extending between said first left vertical support and said first right vertical support, said upper playing surface being supported on said first horizontal support;

wherein said support assembly further includes (i) a second left vertical support, (ii) a second right vertical support, and (iii) a second horizontal support extending between said second left vertical support and said second right vertical support, said upper playing surface being further supported on said second horizontal support;

wherein said first horizontal support is positioned at a greater vertical height relative to said second horizontal support whereby said upper playing surface is oriented to form a downward slope which extends from said first rear edge of said upper playing surface to a front edge of said upper playing surface;

wherein (i) said net is secured in a space defined between said second left vertical support and said second right vertical support, and (ii) said net is further secured below said second horizontal support; and wherein (i) said upper playing surface is interposed between said return surface and said lower playing surface, (ii) said support assembly further includes a third horizontal support extending between said first left vertical support and said first right vertical support, and (said return surface is supported on said third horizontal support.

15. The table tennis assembly of claim 14, wherein said third horizontal support is positioned vertically above said first horizontal support.

16. A table tennis assembly, comprising:

a net;

a lower playing surface positioned on a first side of said net;

an upper playing surface positioned on a second side of said net, said upper playing surface being oriented in relation to said net and said lower playing surface such that a ping pong ball rolling on said upper playing surface toward said lower playing surface will be directed (i) over said net and (ii) onto said lower playing surface after said ping pong ball rolls off of said upper playing surface; and a game base having a number of pool pockets defined therein, wherein said net, said lower playing surface, and said upper playing surface are attached to said multipurpose game base.

17. The table tennis assembly of claim 16, further comprising a return surface, wherein:

said upper playing surface is interposed between said return surface and said lower playing surface, and said return surface extends upwardly from a rear edge of said upper playing surface.

18. The table tennis assembly of claim 16, further comprising a support assembly secured to said game base and said upper playing surface which positions said upper playing surface at a height above said lower playing surface, wherein said support assembly includes:

a first left vertical support, a first right vertical support, and a first horizontal support extending between said first left vertical support and said first right vertical support, said upper playing surface being supported on said first horizontal support.

* * * * *